United States Patent [19]

Coggins et al.

[11] 4,116,755

[45] Sep. 26, 1978

[54] CHEM-MILLING OF TITANIUM AND REFRACTORY METALS

[75] Inventors: Dolphus L. Coggins, St. Louis; John Gumbelevicius, Creve Coeur, both of Mo.

[73] Assignee: McDonnell Douglas Corporation, St. Louis, Mo.

[21] Appl. No.: 830,565

[22] Filed: Sep. 6, 1977

[51] Int. Cl.[2] ..... C23F 1/02

[52] U.S. Cl. ..... 156/659; 156/664; 252/79.3; 252/79.4

[58] Field of Search ..... 252/79.2, 79.3, 79.4, 252/79.5, 142, 146, 147, 148; 156/664, 659; 134/3, 41; 427/309

[56] References Cited

U.S. PATENT DOCUMENTS

| | | | |
|---|---|---|---|
| 3,166,444 | 1/1965 | Ehren et al. | 252/142 X |
| 3,491,027 | 1/1970 | Baker | 134/3 X |
| 3,749,618 | 7/1973 | Fannin et al. | 252/79.3 X |
| 3,788,914 | 1/1974 | Gumbelevicius | 156/664 |

*Primary Examiner*—William A. Powell
*Attorney, Agent, or Firm*—Gravely, Lieder & Woodruff

[57] ABSTRACT

An improved composition and process for chemically milling titanium, refractory metals, and their alloys, resulting in decreased absorption of hydrogen, thus allowing chemical milling of beta titanium and alpha beta titanium, which normally cannot be chemically milled in conventional chemical milling solutions because of hydrogen embrittlement.

The chemical milling solution itself consists of a mixture of nitric acid; hydrofluoric acid or fluoride salts; derivatives of carbonic acid, such as carbamide; derivatives of monocarboxylic acids containing alkali metal ions, such as sodium benzoate; and a source of sodium ions compatible with the remainder of the composition, preferably sodium nitrate.

The addition of sodium benzoate results in a more uniform metal removal rate, thus permitting the producing of high precision parts.

13 Claims, No Drawings

CHEM-MILLING OF TITANIUM AND REFRACTORY METALS

BACKGROUND OF THE INVENTION

Gumbelevicius U.S. Pat. No. 3,788,914 discloses a composition and process of chemically milling titanium, refractory metals, and their alloys with little hydrogen absorption in the alloys and uniform titanium removal rates. The solution comprises nitric acid, hydrofluoric acid, and derivatives of carbonic acid. The solution may also include surfactants when proper fillet radii configuration of the chemically milled parts is important. Suitable surfactants include dodecyl benzene sulfonic acid and alkyl benzene sulfonate.

Coggins et al U.S. Pat. No. 3,944,496 discloses a solution for chemical milling which contains nitric acid, hydrofluoric acid, phosphoric acid, and carbamide. This composition too, can contain a surfactant.

Gumbelevicius Ser. No. 659,770 filed Feb. 20, 1976, entitled CHEMICAL MILLING OF TITANIUM AND REFRACTORY METALS discloses a composition for pickling and chem-milling in which the nitric acid is eliminated but which includes a surfactant.

The reduction of surface tension (the function of surfactants) is required for extremely accurate work. However, the use of the prior art surfactants results in several problems in chemical milling in the field.

The use of surfactants leads to difficulty in maintaining the surface tension of the solution at a constant level due to decomposition of the surfactant itself. The varying level of surface tension results in a variance in metal removal rate, and "grooving" along chem-mill lines.

The use of surfactants also causes foaming. Foaming is undesirable in that it limites the number of parts which can be chemically milled at one time.

Furthermore, the alloying elements in the titanium alloys and the refractory metal alloys (primarily aluminum) slowly form hard scales which adhere tightly to surfaces of the equipment in which the alloys are being milled, and particularly to the heat exchangers. This results in difficult equipment maintenance problems. The addition of sodium nitrate causes the formation of loose, non-adherent, easily removable sludge, rather than hard, adherent scale.

It has been discovered that problems associated with surfactants can be eliminated by replacing the surfactant with sodium benzoate. In addition, sodium benzoate improves the flow characteristics of the chem-milling solution. This improvement of flow characteristics eliminates excessive metal removal in the fillets. This metal removal, known as "grooving", is a normal occurrence when the surfactant is not present or when it has been depleted to a very low level. Unlike conventional surfactants, large amounts of sodium benzoate do not cause excessive metal removal in the center of the chem-milled area. This type of excessive removal is known as "dishing". Furthermore, sodium benzoate eliminates tapering along the fillet lines which is detrimental for high precision chem-milling.

SUMMARY OF THE INVENTION

The present invention involves a chemical milling solution for milling titanium, refractory metals, and their alloys, specifically beta and alpha beta titanium alloys, with little hydrogen absorption in the alloys and uniform titanium removal rates. The solution comprises nitric acid, hydrofluoric acid, derivatives of carbonic acid, sodium benzoate, and sodium nitrate.

The addition of sodium benzoate results in a more uniform metal removal rate, which, in turn, allows production of high precision parts at higher metal removal rates than previously possible.

DETAILED DESCRIPTION

The following is a specific detailed disclosure of a preferred process of chemically milling titanium, specifically beta titanium alloy. 1. The specimen (beta titanium alloy) is cleaned with trichloroethylene to remove contaminants such as grease, oil, etc. This pre-treatment is necessary for removal of oil, grease, and other contaminants normally found on parts of metal fabrication. The purpose of this cleaning is twofold: (a) to eliminate contamination of chem-milling solution, and (b) to provide a clean surface for proper masking adhesion. Both factors are important to produce acceptable parts; however, these factors do not affect hydrogen absorption and thus are incidental with respect to the invention. 2. The specimen is dipped into a neoprene base maskant. This is a proprietory compound supplied by Turco Products, Inc. The maskant is at room temperature, and has a viscosity of 40 seconds as measured with Zahn No. 5 viscometer. This is a conventional solution and the step is well-known in this art. 3. The coated specimen is permitted to dry at room temperature (about 76° C) until tack free condition. This takes about 20 minutes. 4. Dipping and drying between dipping is repeated three more times to apply four coats of mask which provides about 0.3 mm thick coating. The thickness of the mask is not critical and may vary by as much as 50%, depending upon the size of the parts, shop practices, and depth of chem-milling. 5. After the final coat, the specimen is kept at room temperature for about six hours to permit evaporation of solvents from the coating. 6. Then the masked specimen is baked at 200° F for 1 hour. This treatment polymerizes the coating and renders it inert to chemical milling solution. The described procedure is well-known in the industry, but the methods may vary widely depending on shop practices. 7. The chem-milling template, previously made from steel, is applied to the specimen. The template is designed to serve as a guide for the scribbing knife to obtain the chem-milling pattern. The knife used is a commercial type X-Acto scribing knife or any other means to cut the mask, such as a so-called "hot knife," operating on low voltage DC current. It is a well-known practice in chemical milling industry. 8. After all the lines for chem-mill pattern are cut through the maskant, but not into the metal, the template is removed and the maskant is peeled by hand from the areas to be chem-milled. 9. The specimen is transferred into the chem-milling solution. The solution composition is as follows: 682 g of nitric acid, 63 g of hydrofluoric acid, 40 g of carbamide, 5 g of sodium benzoate, 12 g of sodium nitrate, and water to make a total volume of 1 liter. The solution is at 57° C and is agitated by means of an electric stirrer or other suitable means such as continuous circulation by pumping. The specimen is suspended in the solution using plastic coated wire or other inert material and is left in the chem-mill solution for 6 minutes. 10. After 5 minutes, the specimen is removed from the chem-milling solution, rinsed with cold water, and the amount of metal removal is measured using a micrometer. 0.46 mm of metal was removed which indicates metal removal rate of 0.0767 mm per minute, per surface. 11. As the desired metal removal is 0.767 mm (half the thickness of the test specimens), the test specimen is re-immersed into chemical milling solution for additional 4 minutes to remove the remaining amount of metal and obtain the desired depth of cut (0.767mm). 12. The specimen is removed, rinsed with cold water and the metal removal is checked again with a micrometer to ascertain that 0.767 mm of metal have been removed. 13. The maskant from areas which had not been chem-milled is removed by hand peeling or any other means well-known in the industry such as "peeling" with compressed air.

The chemical milling solution contains preferably 70% by volume of commercially available 67.8 wt. percent nitric acid. The range of nitric acid concentration can be varied between about 126 and about 700 grams of pure nitric equivalent per liter of final solution. Between 1 and 20% by volume of commercially available hydrofluoric acid can be used, although 5–12% of said hydrofluoric acid is preferred. These ranges can be expressed as 12.6–251.6 grams of 70% hydrofluoric acid or about 8.8 to about 176.1 grams of pure hydrofluoric acid equivalent per liter of final solution. While hydrofluoric acid is preferred, fluoride salts such as lithium fluoride, ammonium fluoride, sodium fluoride, potassium fluoride, cobalt fluoride, and the like, may be used.

Carbamide is the preferred carbonic acid derivative and is present in amounts of at least 10 grams per liter of final solution. Preferably the range is from about 20 to about 200 grams per liter. At 200 grams per liter a super saturated solution is produced and increased concentration of carbamide is not more effective. Other carbonic acid derivatives which may be used include urea nitrate, urea oxalate, semicarbazide, and mixtures thereof and the like.

The temperature range of the chemical milling process may be between about 9° C and 110° C, although the preferred range is about 27° C to about 88° C.

The areas of the titanium which are not to be chemically milled may be coated with certain inert coatings, such as neoprene, high melting wax, or other materials inert to the chemical milling solution. Such materials are commercially available.

The critical distinction lies in the use of sodium benzoate as a replacement for surfactant in the chem-milling step of the process of U.S. Pat. No. 3,788,914. The concentration of sodium benzoate may vary between 1.5 and 24 grams per liter of solution. The preferred concentration is 5 grams per liter. Sodium benzoate can be replaced by other derivatives of monocarboxylic acids containing alkali metal ions.

A suitable source of sodium ions, preferably sodium nitrate, is added to the chemical milling solution to prevent scale formation. Suitable substitutes for sodium nitrate include sodium salts compatible with the remainder of the chemical milling solution. The concentration of sodium nitrate is at least about 2 gm/l and may vary from about 0.5 to about 24 grams per liter. The preferred concentration is about 12 grams per liter. This is equivalent to a concentration of sodium ions of about 0.541 to about 6.49 g/l derived from sodium nitrate.

The use of sodium benzoate results in an absence of foaming. This characteristic allows chemical milling at an etch rate of 4–5 times faster than the rate attained by using the process disclosed in the U.S. Pat. No. 3,788,914. Uniform metal removal rate and absence of foam allow the conventional metal removal rate of 0.025 mm/surface/min to be increased to 0.15 mm/surface/min. However, the metal removal rate of 0.025 mm/surface/minute or even lower could be used, without loss of benefits if so desired.

Other advantages resulting from use of the present composition include more consistent tapering section and elimination of hard, difficult-to-remove scale.

What is claimed is:

1. A method of chemically milling and surface treating a material selected from the group consisting of titanium, columbium, molybdenum, tungsten, tantalum, and their alloys without excessive hydrogen absorption comprising the steps of:

(a) exposing said material to a solution containing per liter of solution about 126 to about 700 g pure nitric acid equivalent, an amount of fluoride producing material sufficient to provide the equivalent of about 8.8 to about 176.1 of pure hydrofluoric acid, at least 10 grams of a derivative of carbonic acid, at least about 1.5 gm monocarboxylic acid derivative containing alkali metal ions, (b) at a temperature of about 0°–110° C, (c) for a period of time sufficient to remove the undesired material.

2. The method of claim 1 wherein said solution includes at least about 0.541 g of sodium ions per liter.

3. The method of claim 1 wherein the metal removal rate is between 0.025 mm/surface/min to 0.15 mm/surface/min.

4. The method of claim 1 wherein the monocarboxylic acid derivative is sodium benzoate.

5. The method of claim 1 wherein the carbonic acid derivative is selected from the group consisting of carbamide, urea nitrate, urea oxalate, and semicarbazide.

6. The method of claim 5 wherein the carbonic acid derivative is carbamide.

7. The method of claim 2 wherein material from which the portion of sodium ions come is sodium nitrate.

8. A composition for chemically milling and surface treating a material selected from the group consisting of titanium, columbium, molybdenum, tungsten, tantalum, and their alloys without excessive hydrogen absorption comprising per liter of solution (a) about 126 to about 700 g pure nitric acid equivalent, (b) an amount of fluoride producing material sufficient to provide the equivalent of about 8.8 to about 176.1 of pure hydrofluoric acid, (c) at least 10 grams of a derivative of carbonic acid and (d) at least about 1.5 gm monocarboxylic acid derivative containing alkali metal ions.

9. The composition of claim 8 wherein said solution includes at least about 0.541 g of sodium ions per liter.

10. The composition of claim 8 wherein the monocarboxylic acid derivative is sodium benzoate.

11. The composition of claim 8 wherein the carbonic acid derivative is selected from the group consisting of carbamide, urea nitrate, urea oxalate, and semicarbazide.

12. The composition of claim 8 wherein the carbonic acid derivative is carbamide.

13. The composition of claim 9 wherein the material from which the portion of sodium ions come is sodium nitrate.

* * * * *